US010888974B1

(12) United States Patent
Andruchow

(10) Patent No.: US 10,888,974 B1
(45) Date of Patent: Jan. 12, 2021

(54) JEWELRY TOOL

(71) Applicant: Robert J. Andruchow, Norwalk, CT (US)

(72) Inventor: Robert J. Andruchow, Norwalk, CT (US)

( * ) Notice: Subject to any disclaimer, the term of this patent is extended or adjusted under 35 U.S.C. 154(b) by 0 days.

(21) Appl. No.: 15/852,266

(22) Filed: Dec. 22, 2017

Related U.S. Application Data

(63) Continuation of application No. 62/437,970, filed on Dec. 22, 2016.

(51) Int. Cl.

| | |
|---|---|
| ***B24D 15/04*** | (2006.01) |
| ***B24B 23/06*** | (2006.01) |
| ***B24D 11/06*** | (2006.01) |
| ***B24D 15/00*** | (2006.01) |
| ***B24D 11/00*** | (2006.01) |
| ***A44C 27/00*** | (2006.01) |
| ***B24B 21/20*** | (2006.01) |
| ***B24D 15/02*** | (2006.01) |
| *B24D 18/00* | (2006.01) |

(52) U.S. Cl.
CPC ..... *B24D 15/00* (2013.01); *A44C 27/001* (2013.01); *B24B 21/20* (2013.01); *B24B 23/06* (2013.01); *B24D 11/00* (2013.01); *B24D 11/06* (2013.01); *B24D 15/026* (2013.01); *B24D 15/04* (2013.01); *B24D 18/009* (2013.01)

(58) Field of Classification Search
CPC ..... A44C 27/001; B24D 15/00; B24D 11/00; B24D 18/009; B24D 15/04; B24D 11/06; B24D 15/023; B24D 15/026; B65H 75/48; B24B 21/00; B24B 21/20; B24B 21/22; B24B 23/06
USPC ..... 451/492, 513, 519, 523, 524, 525
See application file for complete search history.

(56) References Cited

U.S. PATENT DOCUMENTS

| | | | | |
|---|---|---|---|---|
| 1,567,783 | A * | 12/1925 | Best | A45F 5/004 242/376 |
| 2,155,037 | A * | 4/1939 | Churgin | B24B 45/00 451/510 |
| 3,849,945 | A | 11/1974 | Lindzy | |
| 4,927,354 | A * | 5/1990 | Sanford | F23Q 2/34 206/87 |
| 6,003,474 | A * | 12/1999 | Slater | A01K 27/009 119/859 |
| 6,241,750 | B1 * | 6/2001 | Moultrie | A45F 5/004 606/234 |
| 6,290,586 | B1 | 9/2001 | Adams | |
| 6,641,390 | B2 * | 11/2003 | Genuise | A45F 5/004 206/87 |
| 7,195,413 | B2 * | 3/2007 | Kremizis | A45F 5/004 224/162 |
| D539,528 | S * | 4/2007 | Hastings | D3/215 |
| RE40,379 | E * | 6/2008 | Hastings | D3/215 |
| 7,452,100 | B2 * | 11/2008 | Swartfager | F21V 23/0414 362/192 |
| D653,722 | S * | 2/2012 | Morris, Jr. | D21/796 |
| 8,439,678 | B1 * | 5/2013 | Chen | A61C 3/12 433/142 |

(Continued)

FOREIGN PATENT DOCUMENTS

| | | |
|---|---|---|
| WO | 8402300 A1 | 6/1984 |

*Primary Examiner* — Eileen P Morgan
(74) *Attorney, Agent, or Firm* — Ohlandt, Greeley, Ruggiero & Perle, L.L.P.

(57) ABSTRACT

Tooling strips and tools for using tooling strips.

18 Claims, 8 Drawing Sheets

(56) References Cited

U.S. PATENT DOCUMENTS

| | | | | |
|---|---|---|---|---|
| 8,833,310 | B2 * | 9/2014 | Konigsberg | A01K 27/00 119/770 |
| D850,293 | S * | 6/2019 | Burns | D10/37 |
| 2002/0000455 | A1 * | 1/2002 | Condliff | A45F 5/004 224/162 |
| 2008/0072844 | A1 * | 3/2008 | Konigsberg | A01K 27/00 119/770 |
| 2008/0141950 | A1 * | 6/2008 | Glazer | A01K 27/004 119/770 |
| 2008/0235892 | A1 * | 10/2008 | Williams | A47K 7/02 15/210.1 |
| 2008/0265082 | A1 * | 10/2008 | Angiuli | A45F 5/004 242/400 |
| 2009/0294495 | A1 * | 12/2009 | Moreau | A45F 5/00 224/219 |
| 2010/0032465 | A1 * | 2/2010 | Moreau | A45F 5/004 224/660 |
| 2010/0206976 | A1 * | 8/2010 | Salentine | A45F 5/004 242/379.2 |
| 2012/0234260 | A1 * | 9/2012 | Shaw | A47D 13/086 119/770 |
| 2014/0213161 | A1 | 7/2014 | Hopkins | |
| 2015/0164204 | A1 * | 6/2015 | Moreau | A45F 5/00 224/267 |
| 2016/0207724 | A1 * | 7/2016 | Everts | B65H 35/002 |
| 2018/0098612 | A1 * | 4/2018 | Lamendola | A45D 26/0066 |
| 2019/0134806 | A1 * | 5/2019 | Bain | B25H 1/0028 |

* cited by examiner

JEWELRY TOOL

CROSS REFERENCE TO RELATED APPLICATIONS

The present patent application claims priority to U.S. Provisional Patent Application 62/437,970 entitled JEWELRY TOOL and filed on Dec. 22, 2016, the entirety of which is incorporated by reference hereby.

DESCRIPTION OF RELATED ART

Flexifile, by Creations Unlimited Hobby Products, Dept. P, Grand Rapid, Mich. 49505, offers the user a symmetrically disposed, two loop, banded fine abrasive member supported by two pins at the ends of a handheld C-shaped holder. In such a configuration, the C-shaped holder is weak and provides only gross abrasives with a limited number of sizes. The depth of the holder is limited to approximately 4 inches, which limits application use. The system does not allow the user to hang enclosed jewelry, such as rings, onto the multiple abrasive members to work the inner part of the jewel. The abrasive member is very weak, and is of limited for fine abrading for jewelry.

A coping saw consists of a thin, hardened steel blade, stretched between the ends of a square, c-shaped, springy-iron frame to which a handle is attached. The blade is easily removed from the frame so that the blade can be passed through enclosures, for example a drilled hole in the middle of a piece of wood. The frame is then re-attached to the blade and the cut starts from the middle of the piece. Jewelry makers make recourse to the coping saw as the blade can be passed through enclosed jewelry to abrade the inner material, but the relative large size of the frame to jewelry and the handle's position in line with the saw makes the coping saw very unwieldy for fine abrading or carefully guiding the work.

A retractable badge reel is a device comprising a case inside of which is a reel with a tether wrapped around it. The reel is configured such that the free end of the tether can be pulled, thereby rotating the reel. Tether tension is provided by a flat coil spring; as the tether is pulled out of the case, the spring tightens. When the end of the tether is released, the tether can be rewound—either automatically by the unwinding of the spring; or through some manual manipulation, e.g., winding of a lever or via a push-button release, which allows the spring to rewind the tether. The case typically has a clip on its backside for securing it to a shirt pocket, pants waistband, or the like, of a wearer. The free end of the tether is usually attached to a bob, which in turn is attached to a badge, keys, a holding strap, access cards or of the like. In use, the party pulls on the key or object at the end of the reel, unreeling the cable from the reel. When the operation is finished, the party releases the object and the spring automatically winds the cable on the reel into the housing.

SUMMARY

According to an embodiment, disclosed is an abrasive tooling strip having a width of from about 0.5 mm to about 3 mm and a grit of from about 240 grit about 600 grit. The strip can include grit selected from the group of: from about 240 grit to about 400 grit, and from about 280 grit to about 320 grit. Exemplary abrasive material for the strip can include silicon grit, aluminum grit, diamond grid, and carbon grit.

According to another embodiment, disclosed is a precision tool comprising: a base section and a pair of extended arms; and an affixing portion at the end of each of the arms for affixing a strip of tooling material to the tool between the arms, the affixing portion including a fastener for attaching and detaching the tooling material to and from the tool, wherein the pair of extended arms are configured to fit the grip of a user's hand.

In an embodiment, the pair of extended arms can be from about 2.5 inches to about 5" long; and the width between the affixing portions at the end of each of the arms can be from about 1.75" to about 3.5".

In an embodiment, the pair of extended arms can be about 5" long; and the width between the affixing portions at the end of each of the arms can be about 2" long.

In an embodiment, the pair of extended arms can extend to about 2.75" long; and the width between the affixing portions at the end of each of the arms can be about 3.25" long.

In an embodiment, the tool can comprise a finger grip area on at least one of the arms.

In an embodiment, the tool can be configured to affix a tooling material having a width of from about 0.5 mm to about 7 mm.

In another embodiment, described is a jewelry tool comprising: a case having a front face and a back face; a securing unit which is capable of attachment to a tooling strip, the securing unit being connected to an extendable and automatically retracting tether housed inside the case; a free end of the tether which extends outside the case through a hole in the periphery of the case, and a tooling strip mounting unit which is capable of releasably attaching the tooling strip.

In an embodiment, the tool's spring can be selected and/or configured to have a pull tension optimal for tooling and abrading of jewelry, precious metals, and like items. In an embodiment, the spring can be configured to have a pull tension for different loads and friction for different degrees of abrading and tooling.

In an embodiment, the tool can have a spring tension of from about 1 ounce to about 14 ounces of pull. In an embodiment, the tool can have a spring tension of from about 8 to about 14 ounces of pull. In an embodiment, the tool can have a spring tension of about 12 ounces of pull.

In an embodiment, the tool can have a spring tension from about 4 ounces to about 7 ounces of pull for medium tooling. In an embodiment, the tool can have a spring tension of about 6 ounces of pull.

In an embodiment, the jewelry tool can have a spring tension from about 1 ounce to about 3 ounces of pull. In an embodiment, the tool can have a spring tension of about 2 ounces of pull.

In an embodiment, the tool further comprises: a strap attachment configured to attach the tool to a user's arm. In an embodiment, the strap attachment comprises an adjustable strap attached to the lower portion of the case and configured to allow user place the tool on the arm and free both hands for tooling an item.

BRIEF DESCRIPTION OF THE DRAWINGS

Embodiments are illustrated in the figures of the accompanying drawings, which are meant to be exemplary and not limiting, and in which like references are intended to refer to like or corresponding things.

DETAILED DESCRIPTION OF THE EMBODIMENTS

Embodiments disclosed herein provide devices and methods for tooling and working items such as jewelry and the like.

Figure 3:
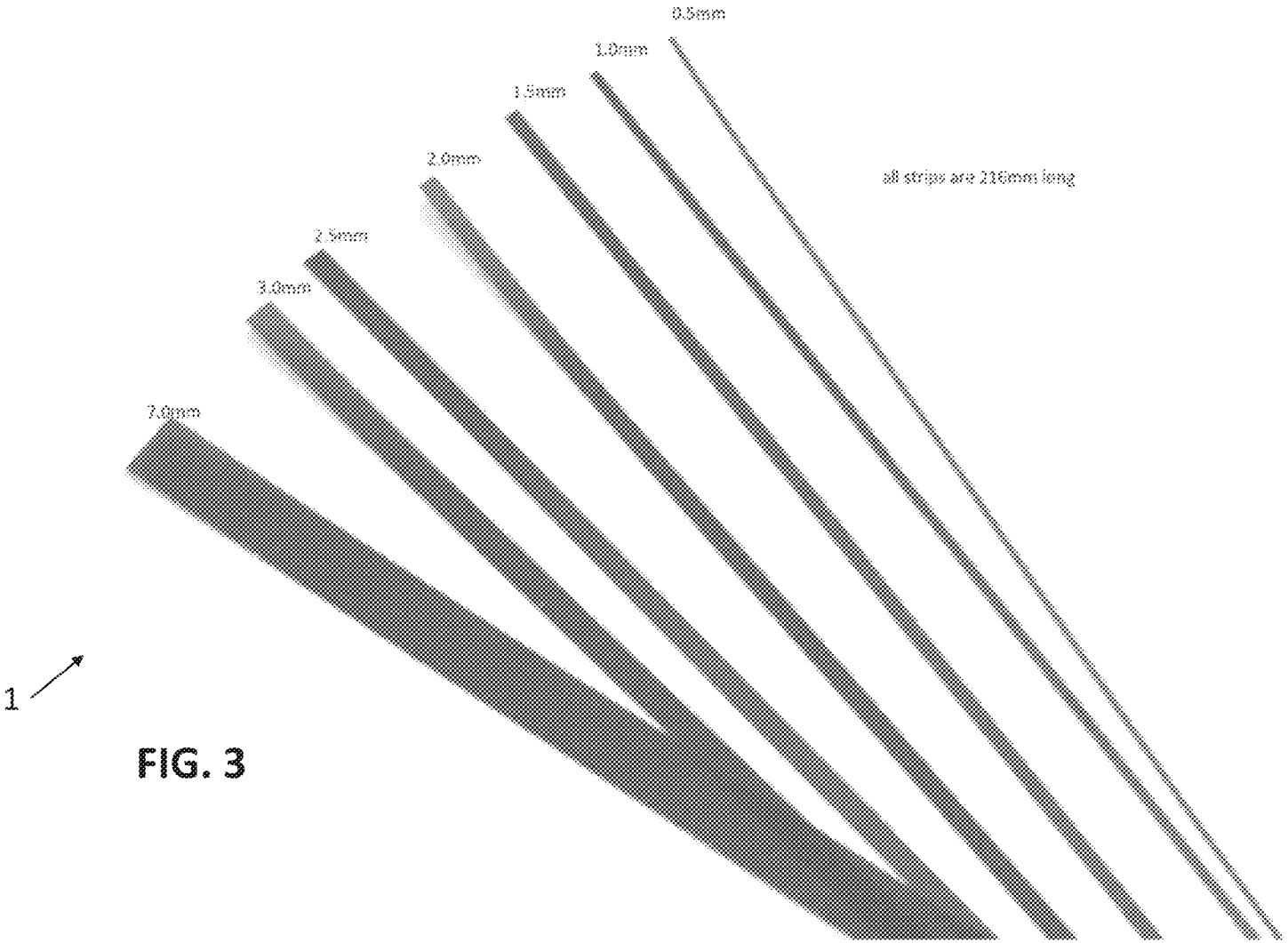
FIG. 3 depicts embodiments of tooling strips.

In at least one embodiment, tools as described herein are configured to use a "microstrip" tooling material. For example, at least one embodiment of a tooling strip 1 comprises an abrasive strip having a width of from about 0.5 mm to about 7 mm. For example, different strip sizes of tooling strips can be employed for different kind of work as well. For example, a larger strip of 1.5-7 mm can be used for medium or larger areas of an item being tooled, whereas a smaller width of 0.5 mm to 1.5 mm can be employed for smaller areas of an item, such as prongs or filigree of an item of jewelry. Strip length can vary depending on tool design as described herein, being anywhere from a few inches to 2 feet or more so long as the tooling strip is long enough to fit the tool 10 and work the item. As shown in FIG. 3, exemplary strip widths can be 0.5 mm, 1.0 mm, 1.5 mm, 2.0 mm, 2.5 mm, 3.0 mm and 7.0 mm. Strip lengths are at least a length to fit between the arms of the tool when affixed to the tool. For example, as shown in FIG. 3, strips are about 215 mm long, which are a uniform size to fit in different embodiments of the tool as described herein. However, as will be appreciated, in embodiments, different lengths can fit different tools as well.

The abrasive tooling strip can include a grit of from about 240 grit about 600 grit. In at least one embodiment, the abrasive strip includes a grit of from about 240 grit to about 400 grit. In at least one embodiment, the strip includes "fine" grit of from about 280 grit to about 320 grit. In an embodiment, the abrasive strip can be a "medium" grit of over 320 grit to about 600 grit. In embodiments the abrasive strip can be a course grit of over 600 grit, for example from about 600 grit to about 800 grit. The abrasive strip can include abrasive materials as known in the art, for example silicon grit, aluminum grit, diamond grit and carbon grit.

In at least one embodiment, the "microstrip" tooling strip 1 can comprise polishing strips having width of from about 0.5 mm to about 7 mm. Again, different strip sizes of tooling strips can be employed for different kind of work as well. For example, a larger strip of 1.5 or higher can be used for medium or larger areas of an item being tooled, whereas a smaller width of 0.5 mm to 1.5 mm can be employed for smaller areas of an item.

In embodiments, the tooling strip can include elongated tooling materials such as an abrasive strip, a polishing strip (e.g. cloth or similar textile), saws, or blades. As will be appreciated, described are tools which are configured to advantageously use elongated tooling strips, microstrips or cords, collectively referred to as tooling strips herein, such that the tool or the item being tooled can be efficiently oscillated. Embodiments are described in terms of tooling and working jewelry and precious metals (e.g. gold, silver, platinum), however as will be appreciated the tools can be used or configured for other types of tooling and other materials as well, e.g. hobbyists or artisans working plastics, wood, other metals, etc.

Figure 1A:
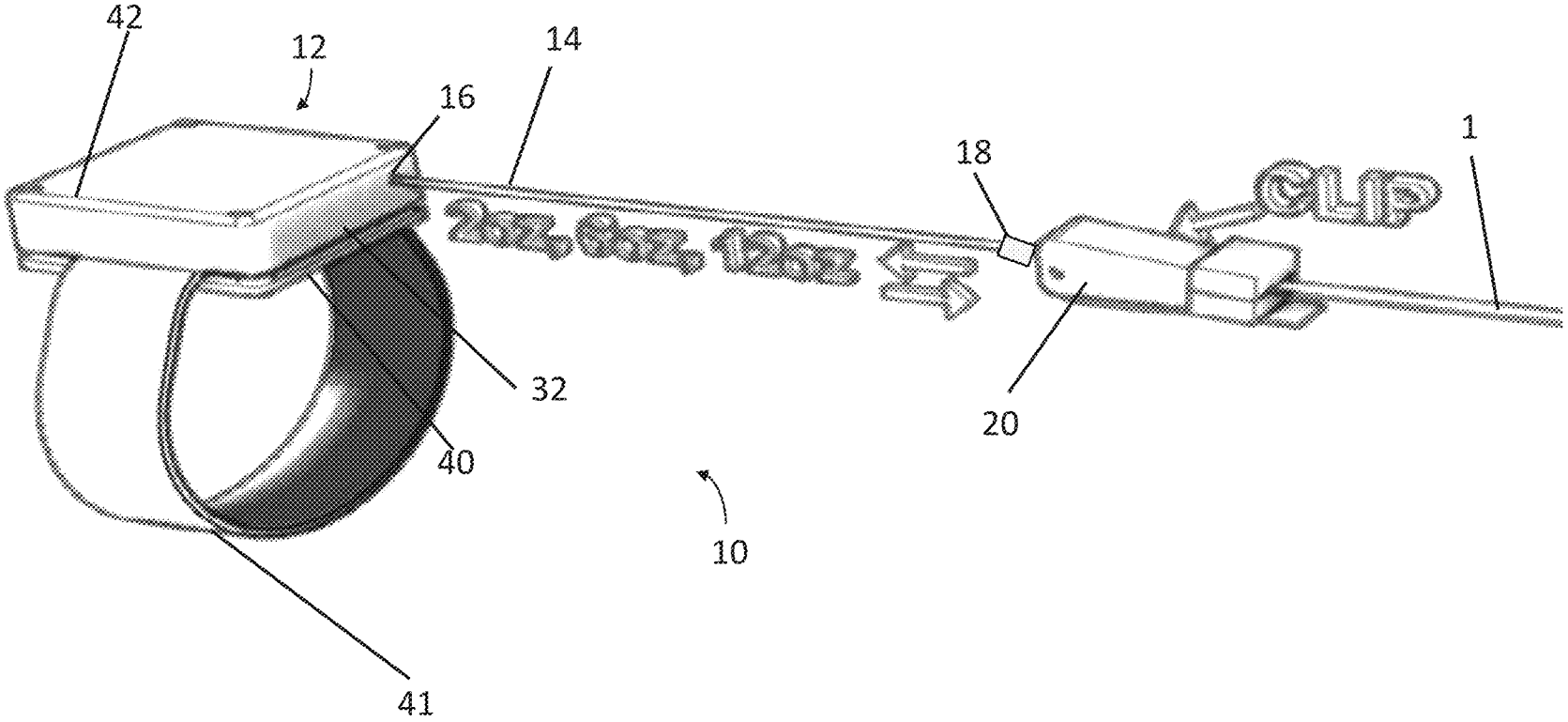
FIGS. 1A to 1E depict at least one embodiment of a tool comprising a retractable reel and detachable tooling strips.
Figure 1B:
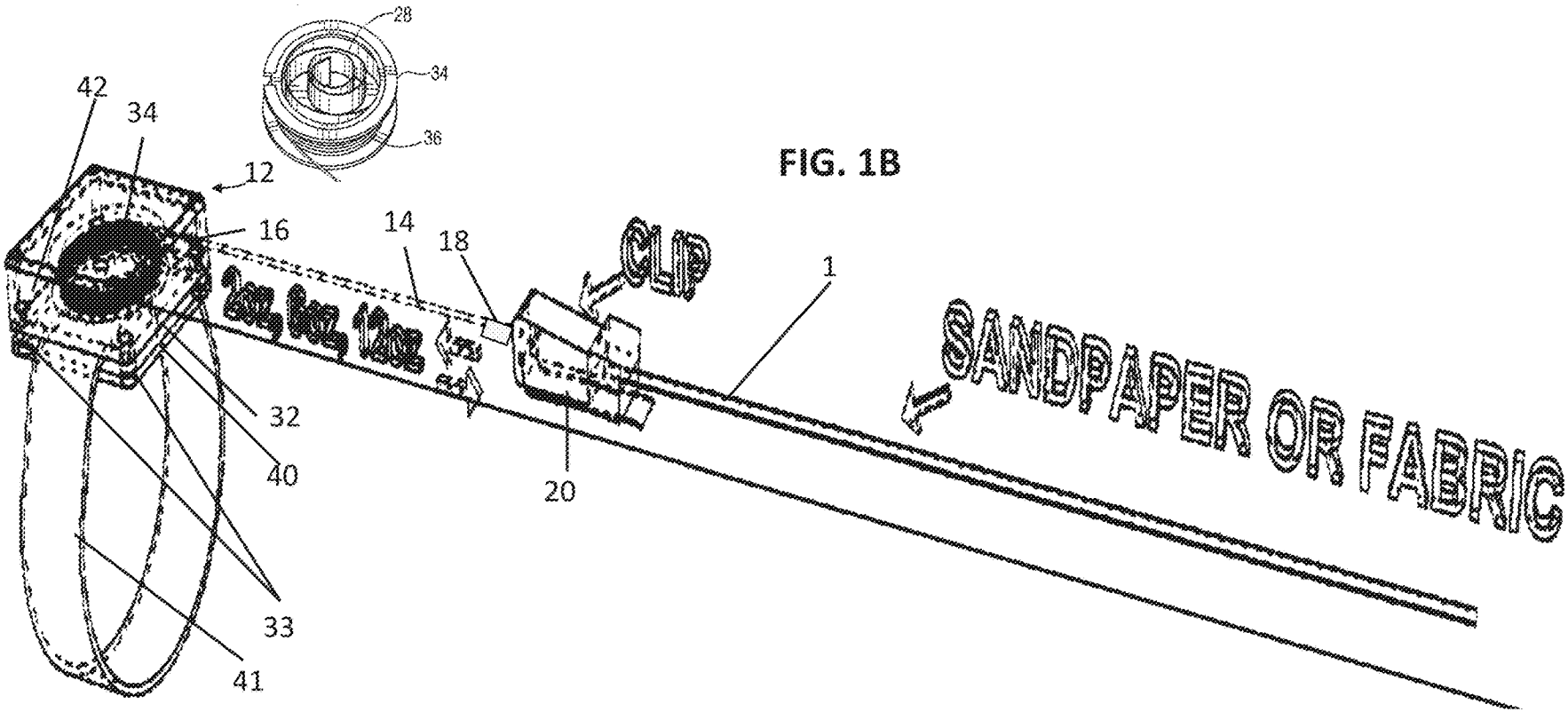
Figure 1C:
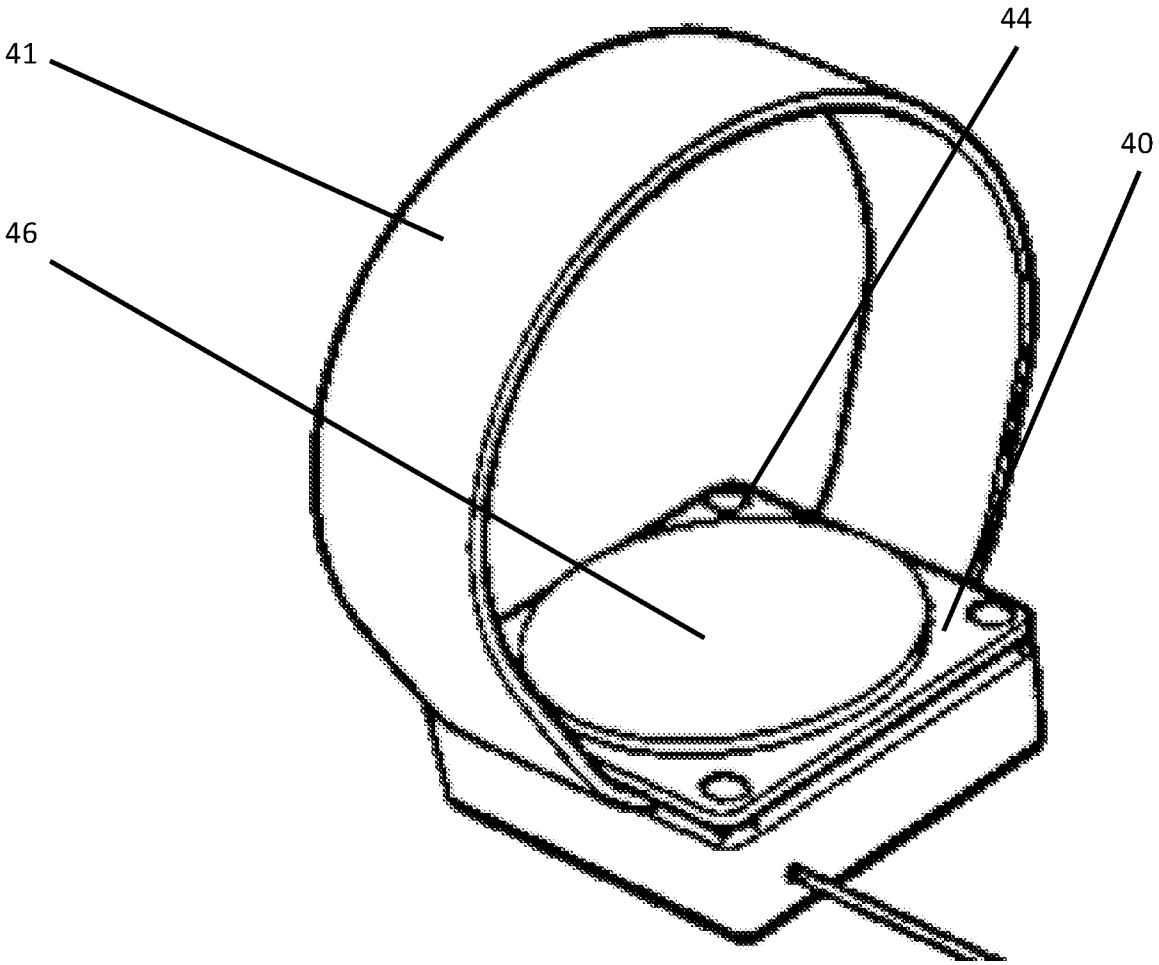
Figure 1D:
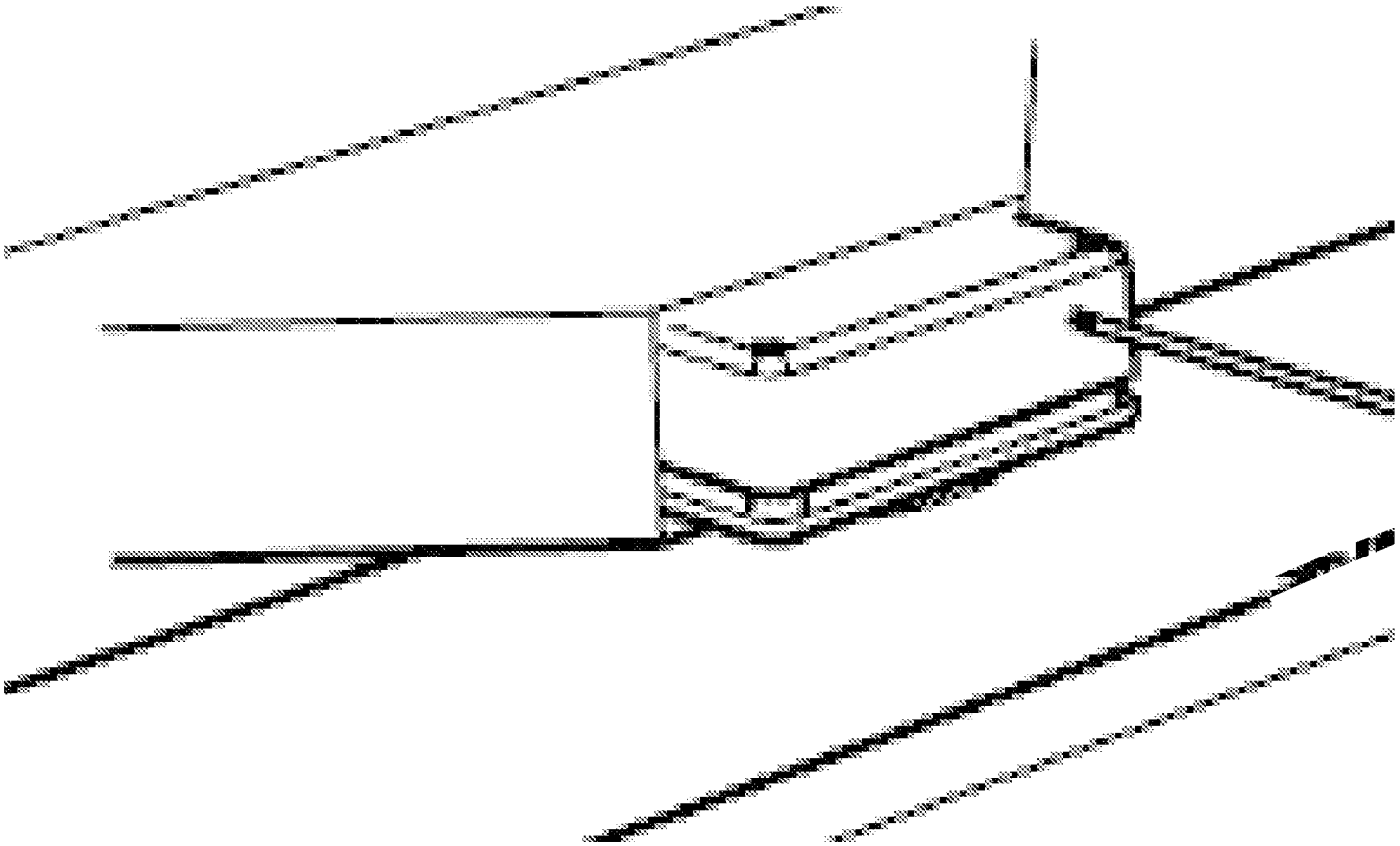
Figure 1E:
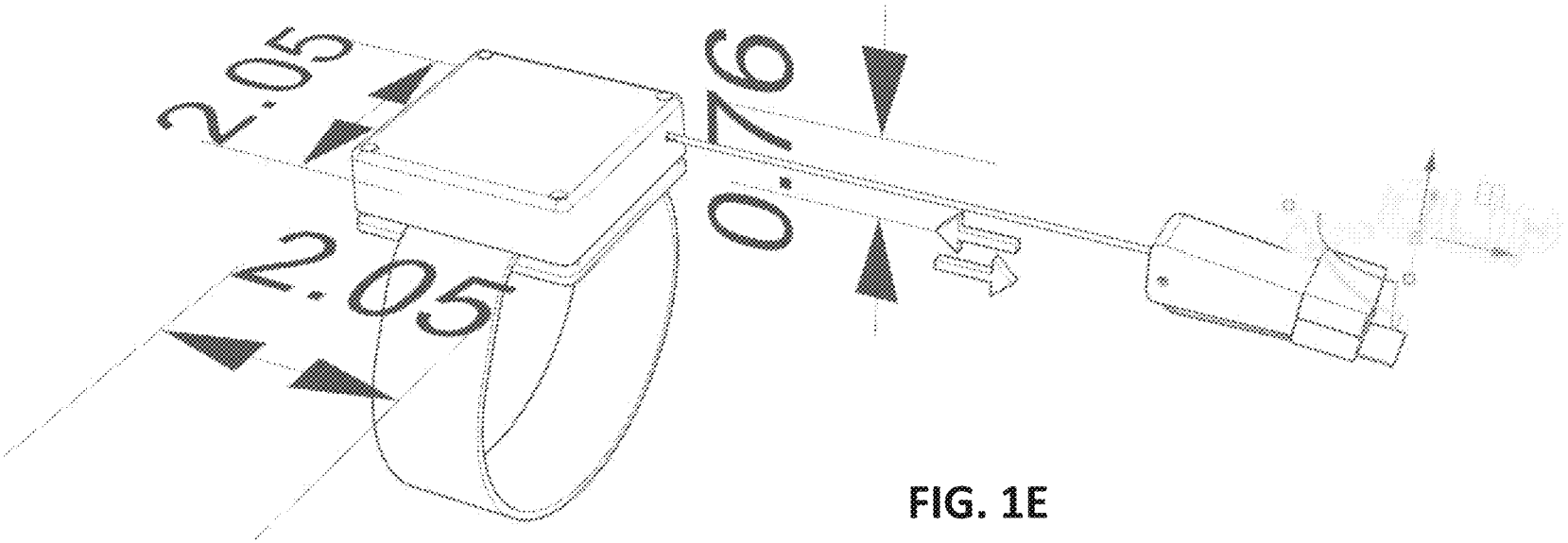

FIGS. 1A to 1E depict a tool 10 comprising a retractable reel and detachable tooling strips 1. Generally, the tool 10 is a device having a case 12 inside of which is an extendable and retractable tether 14. The case 12 is shown in FIGS. 1A-E as having a square shape and configured to mount in a jeweler's pinblock as shown in FIG. 1D; however, the case 12 can have any shape desired, such as a circular shape, an elliptical shape (e.g., oval) or polygonal shape (e.g., triangular, square, rectangular, hexagonal, etc.), as desired. As shown in FIG. 1E, the case dimensions are about 2"×2"×0.75". The tether 14 passes from the interior of the case 12 to the exterior through a port 16 located along the peripheral edge of the case.

In an embodiment, the end of the tether 14 extending through to the exterior side of the case 12 can be attached to a bob 18, which is physically larger that the port. The tether 14 is under tension from within the case 12 such that it tends to want to retract into the case. In a fully retracted mode, the bob 18 is pulled by the tensioned tether 14 against the exterior of the case 12. The presence of the bob prevents the tether 14 from retracting completely into the case.

In an embodiment, the tensioned tether 14 may connect directly to a mounting fastener 20. In this case, mounting fastener 20 acts to prevent the tether from retracting completely into the case.

A tooling strip, such as those mentioned herein, is attached to a mounting fastener 20, shown as a clip, or other mounting fastener 20 when the retractable reel 10 is in use. The mounting fastener 20 is configured to allow the user to readily attach and detach the tooling strip 1.

The tool's 10 normal mode is the aforementioned retracted mode. When the tool 10 is to used, the user pulls the attached tooling strip 1 (e.g., abrading strip, saw, or polishing strip) away from the case 12 of the tool 10. The portion of the tether 14 contained within the case 12 is played out as the user pulls. It is noted that the length of the tether 14 is made long enough so that the along can be oscillated quickly and repeatedly along the tooling strip to work the item, or in the alternative, the tooling strip 1 can be oscillated using the spring action of the tool 10 as described herein.

For many applications, a tether length of approximately 2-3 feet is sufficient. When the user releases the tooling strip 1, or guides it back toward the case 12, the tension placed on the tether 14 pulls the tether back into the case 12, until the bob 18 or the mounting fastener 20 butts against the periphery of the case.

As shown in FIGS. 1A-1E, the tool has case 12 which is shown as square for illustrative purposes only as it may be rectangular, circular, triangular, oblong and the like. Referring specifically to FIG. 1B, case 12, is provided with an internal retractor spring 28 which is anchored in a slotted cylindrical portion 30 integrally formed with bottom portion 32 of case 12 and is surrounded by a spool 34. The proximal end 36 of tether 14 is secured to spring 28 and wound about spool 34 for responsive co-action therewith when it is desired to tool an item such as jewelry by extending and retracting tether 14 by pulling on and releasing the tooling strip 1 if oscillating the strip, or by extending the strip 1 and tooling the item by oscillating it.

In embodiments the tool's spring 18 is selected and/or configured to have a pull tension optimal for tooling and abrading of jewelry, precious metals, and like items. In an embodiment, the spring 28 is configured to have a pull tension for different loads and friction for different degrees of abrading and tooling. In embodiments, tools 10 can be configured to have, for example, a spring tension of from about 1 ounce to about 14 ounces of pull. In an embodiment, a tool 10 for high load abrading (e.g. for tooling hard metals) can have from about 8 to about 14 ounces of pull, for example about 12 ounces of pull. In an embodiment, the tool 10 can have from about 4 ounces to about 7 ounces of pull for medium tooling, for example about 6 ounces of pull. In another embodiment the tool 10 can have about 1 ounce to about 3 ounces of pull for low or soft abrading and tooling (e.g., for delicate areas such as prongs and settings), for example about 2 ounces of pull.

As noted above, different strip sizes of tooling strips 1 can be employed for different kind of work as well. For example, a larger tooling strip 1 width of 2-7 mm can be used for larger areas of an item, whereas a smaller tooling strip 1 width of 0.5 mm to 1.5 mm can be employed for smaller areas of an item, such as prongs or filigree.

In an embodiment, the upper or lid portion 42 of the case 12 is then secured to lower portion 32. For instance, as shown in FIG. 1B, the bottom of the case is formed to connect and be secured to the lid 42 of the case 12, for example using four rivets, screws, welds, a snap-fit, interference fit, or other known connections.

In an embodiment, as shown in FIG. 1C, the external surface of the lower portion can include four channels 33, which are configured to fit on and be screwed to a pinblock, thereby allowing for a user to tool a small item and use other implements, for example, a microscope. Of course as will be appreciated, the case can be configured to be joined to a pinblock in other configurations. In an embodiment, the case 12 can also be configured and sized to be clamped into a jeweler's pin holder.

In an embodiment, the tool case 12 is configured to mate with a block section of a jeweler's bench as shown in FIG. 1D.

In an embodiment, as shown in FIG. 1C, the lower portion 32 of the case 12 is configured to include a strap 41 for easy attachment of tool to a user's arm. An adjustable strap 41 is passed through the bottom of the tool and secured in place by a bottom plate 40, which attached to the lower portion 32 of the case. As shown in FIGS. 1A-1C, the plate 40 is attached to the lower portion 32 of the case 12, for example by four connectors 44, which can be matched to the four channels 33 on the lower portion of the case 12, which can be fastened to the top of a jeweler's bench as described above. Of course as will be appreciated, the case plate can be joined to the lower portion of the case 12 using other means of connection, for example, welds, rivets, screws, snap-fit, interference fit, and other connectors as known in the art. A pad 46 is placed on the external face of the plate 40 to better secure and protect the user's arm when the tool 10 is in use. The user can then place the tool 10 on the arm, for example on the inner arm about the bicep, freeing both hands for tooling jewelry or another item. The user can hold the item in the hand of the arm that the tool 10 is affixed to and use the opposite hand to oscillate the item along the tooling strip 1 (e.g., abrading strip, saw, or polishing cloth) or oscillate the tooling strip 1 itself in the manner described herein.

Tether 14 is preferably formed of nylon or other durable synthetic material and is, of course, provided with sufficient length to enable the user to move the tooling strip 1 or the item being tooled along the tooling strip 1.

In at least one embodiment, described is handheld tool 100 including detachable tooling strips. As shown in the exemplary embodiments of FIGS. 2A-2B, the tool comprises: a base section 102 and a pair of extended arms 103, 104 including an affixing portion 107 at the end of each of the arms 103, 104 for affixing a strip of tooling material 1 to the tool 110 between the arms 103, 104. Each affixing portion 107 includes a fastener 108 for fastening the tooling material 1 to the tool. The pair of extended arms 103, 104 are spaced apart so as to fit the grip of a user's hand. In an embodiment, the tool includes finger grip area 105, 106 on at least one of the arms 103, 104 so as to contour to the fit of a finger.

Figures 2A, 2B:
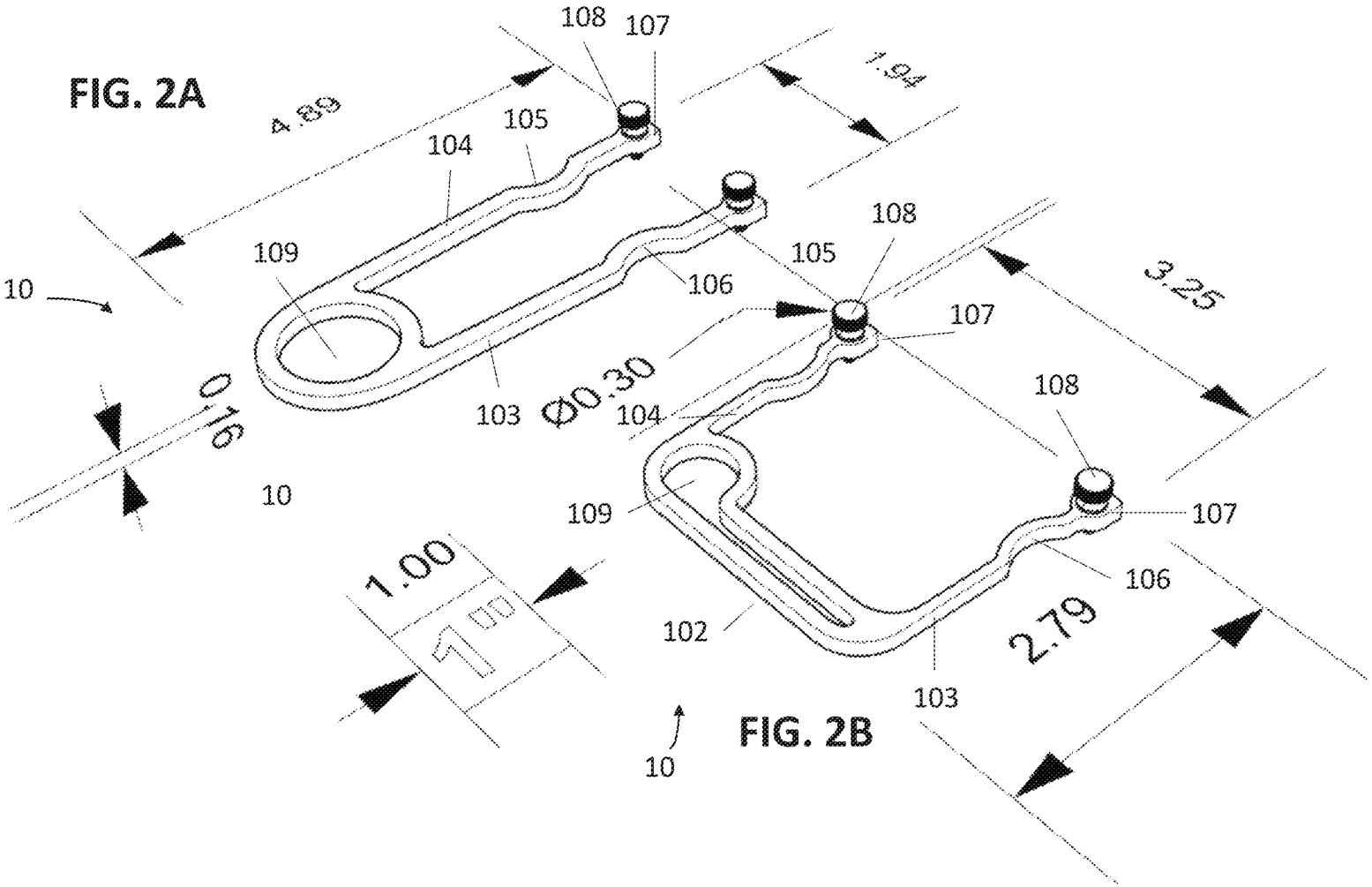
FIGS. 2A-2C depict embodiments of handheld tool including detachable tooling strips
Figure 2C:
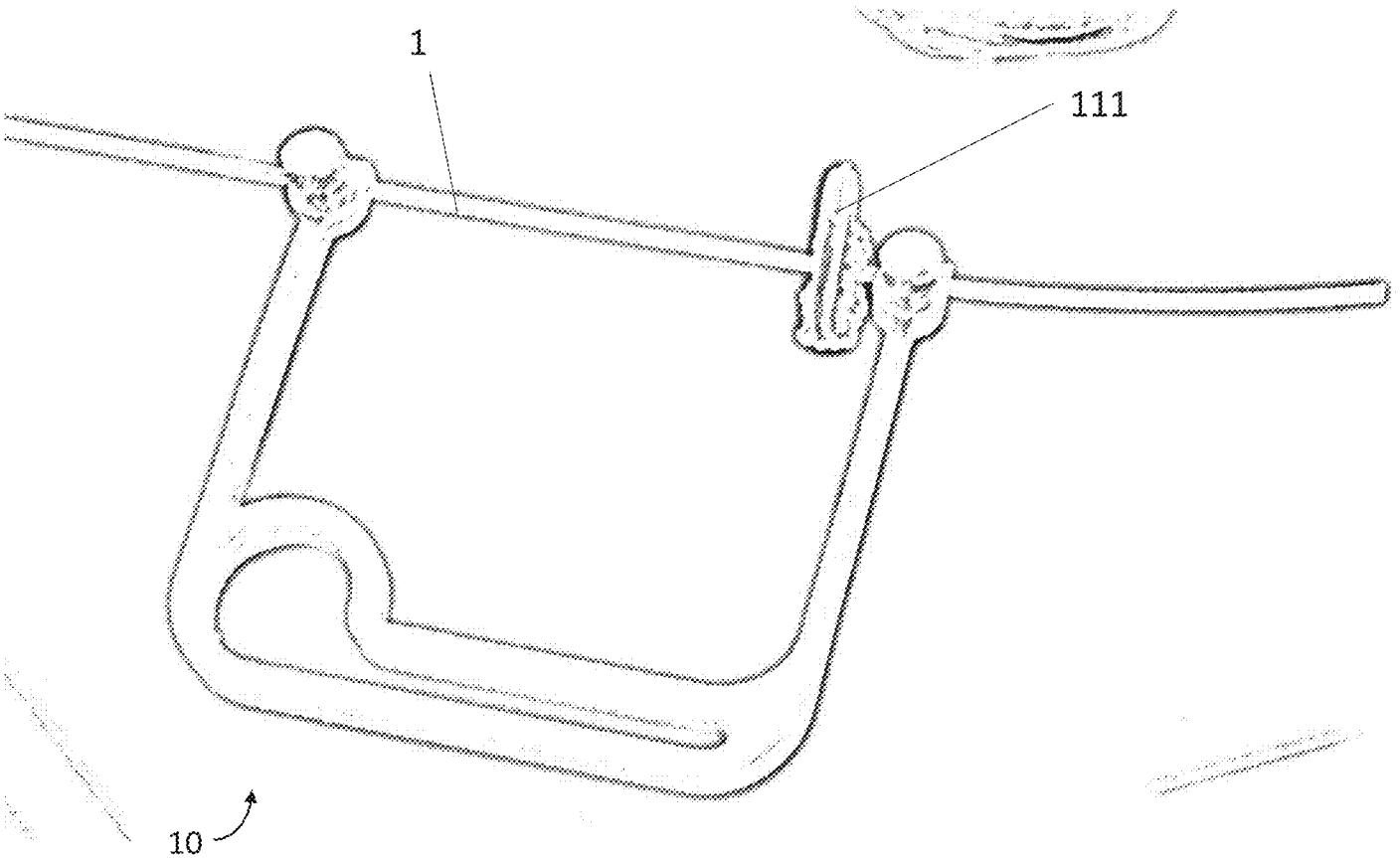

The affixing portion 107 at the end of each of the arms 103, 104 for affixing a strip of tooling material 1 to the tool 110 between the arms 103, 104 is configured to allow for easy attaching and detaching of the tooling strip 1. For example, in an embodiment the tool 100 is configured as a precision jewelry tool, and allows for a user string an enclosed item—of jewelry such as a ring onto the tooling strip and then fasten the strip 1 to the tool 10. As shown in FIG. 2C, the user can fasten one end of the tooling strip 1 onto one arm 103 of the tool 100, string the item 111 onto the tooling strip 1, then fasten the tooling strip 1 to the other arm 104 at the desired tension with the item 111 strung between the arms 103,104. The item 111 can then be tooled by oscillating the item 111 of jewelry or the tool 100 itself. The easy affixing and removal of the tooling strip 1 also allows a user to switch from, for example, coarse, medium and fine grit abrasive microstrips as described herein when tooling the item 111 of jewelry. The user can also switch to polishing strips after sanding jewelry with the abrasive strips.

The pair of extended arms 103, 104 are spaced apart at a width so as to fit the grip of a user's hand, thereby allowing the user to have a free hand for holding and tooling the item 111. FIG. 2A shows a wide grip example of the tool 100, where the tool 100 can hold a longer strip of the working portion of the tooling strip 1, allowing for longer strokes of oscillation. FIG. 2B shows a narrow grip embodiment of the tool 100-1, where the arms 103-1, 104-1 are spaced closer together and each arm 103-1, 104-1 is longer, allowing for a wider range of angular precision and control of the tooling strip 1 when tooling an item. Of course the tool 100 can be configured with other widths and lengths of the arms and the base of the tool to fit within a hand and finger grip.

As shown in FIGS. 2A-2B, the tool 100 is formed as a unitary item, however in embodiments it can be formed from multiple pieces or materials. The tool 100 can be made from a strong, lightweight material such as aluminum or titanium or alloys thereof, plastics or reinforced plastics, or any material allowing for use as a tool as described herein.

As to the manner of usage and operation of embodiments as described herein, it is believed that such is readily apparent from the above description and accordingly no further discussion relative to the usage and operation of the assembly is deemed necessary.

The invention claimed is:

1. A jewelry tool comprising: a case having a front face and aback face and a peripheral edge connecting the front face to the back face an extendable and automatically retracting tether housed inside the case and including a free end of the tether that extends outside the case through a hole in the peripheral edge of the case; a tooling strip mounting unit is attached to a tooling strip, the tooling strip mounting unit being connected to the free end of the tether and configured to releasably attach the tooling strip to the free end of the tether; a spring housed inside the case, the spring connected to an end of the tether opposite the free end, the spring having a pull tension for loads and friction for a targeted degree of abrading and tooling of jewelry with the tooling strip; and wherein the jewelry tool comprises the tooling strip which is attached to the mounting unit, wherein the tooling strip is selected from the group consisting of: an abrasive strip, a fabric polishing strip, and a saw.

2. The jewelry tool of claim 1, wherein the spring has a spring tension of from about 1 ounce to 14 ounces of pull.

3. The jewelry tool of claim 1, wherein the spring has a spring tension of from about 8 ounces to 14 ounces of pull.

4. The jewelry tool of claim 3, wherein the spring has a spring tension of about 12 ounces of pull.

5. The jewelry tool of claim 1, wherein the spring has a spring tension from about 4 ounces to 7 ounces of pull for medium tooling.

6. The jewelry tool of claim 5, wherein the spring has a spring tension of about 6 ounces of pull.

7. The jewelry tool of claim 1, wherein the spring has a spring tension from about 1 ounce to about 3 ounces of pull.

8. The jewelry tool of claim 7, wherein the spring has a spring tension of about 2 ounces of pull.

9. The jewelry tool of claim 1, wherein the jewelry tool further comprises: a strap attachment configured to allow attachment of the jewelry tool to a bicep of a user's arm.

10. The jewelry tool of claim 1, wherein the tooling strip is an abrasive tooling strip.

11. The jewelry tool of claim 10, wherein the grit of the abrasive tooling strip is from about 240 grit about 800 grit.

12. The jewelry tool of claim 11, wherein the grit of the abrasive tooling strip is from about 600 grit to about 800 grit.

13. The jewelry tool of claim 11, wherein the grit of the abrasive tooling strip is from about 240 grit to about 400 grit.

14. The jewelry tool of claim 11, wherein the grit of the abrasive tooling strip is from about 280 grit to about 320 grit.

15. The jewelry tool of claim 10 wherein the grit of the abrasive tooling strip is selected from silicon grit, aluminum grit, diamond grid, and carbon grit.

16. The jewelry tool of claim 1, wherein the tooling strip is a fabric polishing strip.

17. The jewelry tool of claim 1, wherein the jewelry tool is configured to be fixed to a jeweler's pinblock or fixed to a jeweler's bench.

18. The jewelry tool of claim 1, wherein the case further comprises: a plurality of channels in a lower surface of the back face.

* * * * *